United States Patent [19]

Chen

[11] Patent Number: 4,864,690

[45] Date of Patent: Sep. 12, 1989

[54] LATERALLY SWINGING HINGE DEVICE

[76] Inventor: Liang-Erh Chen, 10-1, Alley 6, Lane 44, Chin Men St., Taipei, Taiwan

[21] Appl. No.: 66,985

[22] Filed: Jun. 25, 1987

[51] Int. Cl.[4] ..... E05D 11/04

[52] U.S. Cl. ..... 16/276; 16/224; 16/386

[58] Field of Search ..... 16/224, 235, 276, 240, 16/241, 367, 381, 386; 403/127

[56] References Cited

U.S. PATENT DOCUMENTS 2,065,589 12/1936 Hufferd ..... 403/127

FOREIGN PATENT DOCUMENTS 361623 10/1922 Fed. Rep. of Germany ..... 16/276
454819 10/1936 United Kingdom ..... 16/386
462851 3/1937 United Kingdom ..... 16/386
1196898 7/1970 United Kingdom ..... 403/127

*Primary Examiner*—Nicholas P. Godici
*Assistant Examiner*—Carmine Cuda
*Attorney, Agent, or Firm*—Asian Pacific International Patent & Trademark Office

[57] ABSTRACT

A laterally swinging hinge, which can longitudinally turn back and forth at an angle of approximately 315°, and which is to be mounted on an ordinary door or automobile door; the hinge can also have a laterally swinging angle of at least 5° in either direction so as to eliminate the possible trouble and drawbacks caused by the conventional hinge upon installing two or more than two hinges on one door and upon the center line of the two hinges not being aligned exactly; in that case, the conventional hinges can suffer from a bad friction or cause the door to be bent or unable to be operated normally. The hinge mainly comprises a set of hinge butts, a center shaft being inserted through the cylinder of the hinge butts; the center shaft is substantially a slender cylinder including a ball-shaped part in the mid portion thereof, an upper rod and a lower rod for holding the two butts. There are two sets of steel ball assemblies being mounted on the both ends of the ball-shaped part so as to provide a rolling friction between the center shaft and the butts.

3 Claims, 6 Drawing Sheets

LATERALLY SWINGING HINGE DEVICE

BACKGROUND OF THE INVENTION

The hinge has been an indispensable item in our daily life; for instance, all doors (such as an ordinary door or automobile doors) are always mounted with a hinge or hinges. The conventional hinge usually comprises two hinge butts, such that the cylinders of the butts are assembled together along a straight line around a center shaft. The friction parts of the conventional hinge are the center shaft and the inner walls of the cylinders; considerable surface friction and some noise are generated. The conventional hinge has no provision for lateral play; for instance, two hinges to be mounted on a door have to be installed and aligned along a straight line exactly. No straight line tolerance is allowed; otherwise, the two hinges will have a heavy friction that causes noise and a reduction in service life. When an automobile door is mounted with conventional hinges, the center lines of the hinges have to be aligned carefully and repeatedly; after a given period of time, the hinges tend to become noisy due to misalignment. In the case of a door mounted with three hinges, alignment of the center lines of the hinges becomes extremely difficult.

SUMMARY OF THE INVENTION

One object of the present invention is to provide a hinge that has minimum friction between parts, and minimum noise. The hinge according to the present invention not only has a large turning angle of 315° but also has a lateral misalignment compensation angle of at least 5 degrees in either direction. Should it be necessary to install more than two hinges, there will be no binding or noise even though the center lines of the two hinges are not aligned exactly.

A second object of the invention is to provide a hinge in which one hinge butt includes a cylinder and the other hinge butt includes a shaft adjustably disposed within the cylinder. The middle portion of the shaft is substantially a ball (sphere), mounted between two steel anti-friction ball assemblies so as to provide rolling friction between the steel ball assemblies and the cylinder and associated hinge butts. The arrangement minimizes surface-to-surface friction and associated noise.

A third object of the present invention is to provide a hinge which can be used for ordinary household doors or for automobile doors, i.e. it can be used widely in many areas.

A fourth object of the present invention is to provide a hinge in which a center shaft is directly locked between the ends of a cylinder to prevent the center shaft from dropping out; the hinge can be installed with either end being up (or down).

DETAILED DESCRIPTION

Figure 1:
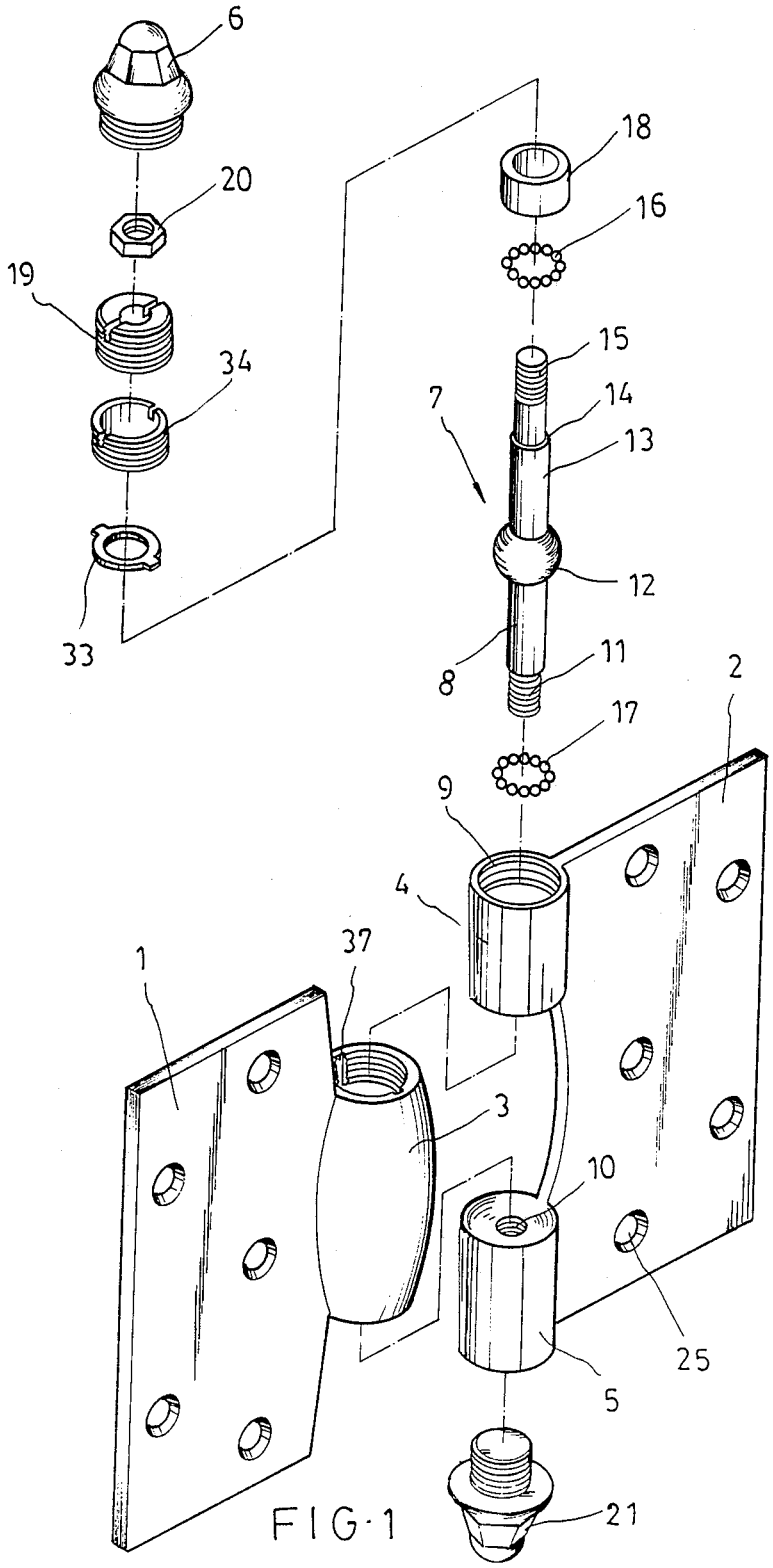
FIG. 1 is a perspective and disassembled view of one embodiment of the present invention.

FIG. 1 illustrates a disassembled view of one form of the present invention, which comprises a hinge butt assembly having a left butt 1 and a right butt 2. A cooperating cylinder assembly includes three parts, i.e., a mid-cylinder 3 attached to the left butt 1, and upper and lower cylinders 4 and 5 attached to the right butt 2. The length of the mid-cylinder 3 is equal to the sum of the lengths of the upper and lower cylinders 4 and 5 so as to balance the forces exerted thereon. Both ends of the mid-cylinder 3 have a curved oblong shape; the diameter of the mid-cylinder 3 is slightly larger than the diameters of the upper and lower cylinders 4 and 5. The inner wall of the upper cylinder 4 is furnished with female threads 9 so as to fit with the top lid (or cap) 6. The top inner wall of the lower cylinder 5 is also furnished with female threads 10 so as to mesh with male threads on the lower rod 8 of the center shaft 7 for thereby fixing the center shaft 7 in place. The mid portion of the center shaft 7 is a ball 12; rod-like section 8 and 13 extend in opposite directions from the ball. Upper rod 13 has a shoulder 14, and threads 15. The lower end of rod 8 is also threaded, as at 11. Two steel antifriction ball assemblies 16 and 17 are mounted closely to the both ends of the ball 12 so as to form a rolling friction device. A steel ball socket 18, pad 33 and threaded sleeve 34 are used for limiting the upper ball assembly 16 to roll within a given space. Pad 33 has two lugs that fit in channels 37 inside the mid-cylinder 3 so as to prevent the the pad 33 from rotating. Threaded sleeve 34 can be used for a long time without becoming loose.

A threaded sleeve 19 is mounted on shoulder 14 of the upper rod section 13 of shaft 7. The threaded area of sleeve 19 is engaged with female threads 9 in the upper cylinder 4. A hexagonal nut 20 is mounted on threads 15 of the upper rod 13. The top end of the upper cylinder 4 is provided with a top lid 6, while the lower end of the lower cylinder is provided with an ornamental bottom lid 21 for decorative purposes. Both of the lids have hexagon sections for rotational purposes.

Figure 2:
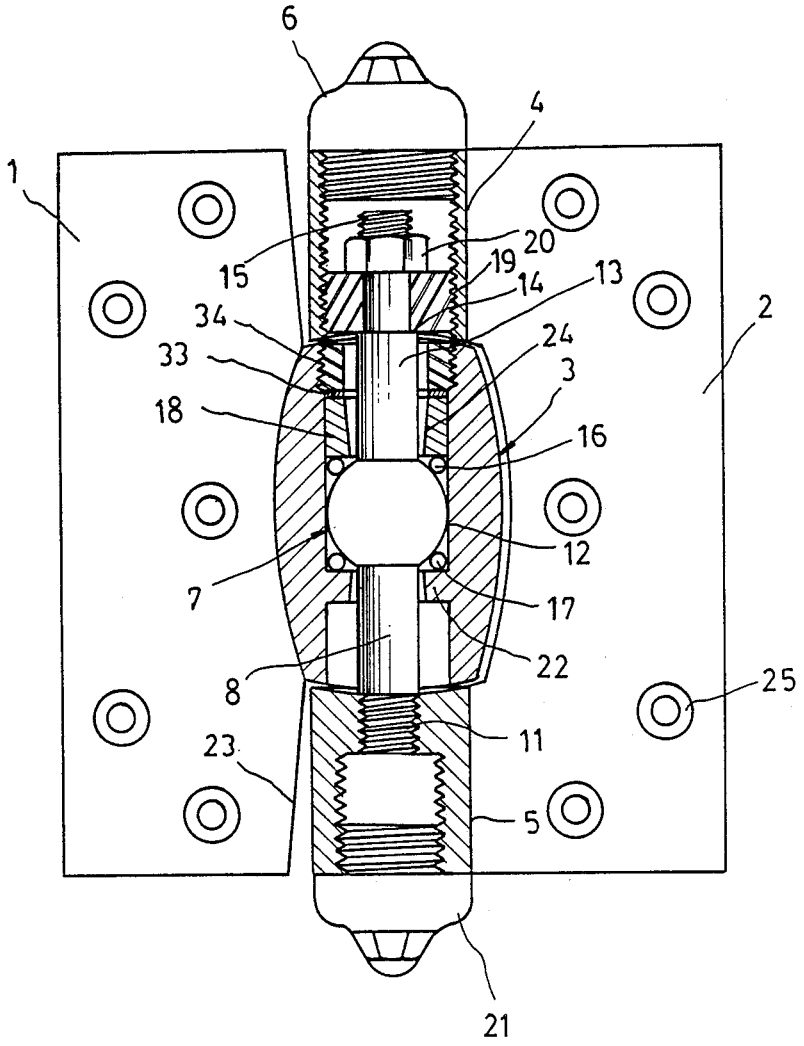
FIG. 2 is a longitudinal sectional view of the FIG. 1 embodiment.

FIG. 2 illustrates a longitudinal sectional view of the embodiment of the present invention in which the left butt 1 and the right butt 2 are assembled together. The upper, mid and lower cylinders are assembled into alignment with one another; the mid cylinder 3 is connected to the left butt 1, while the upper and lower cylinders 4 and 5 are connected to the right butt 2. The inner wall of cylinder 3 is furnished with a flange 22 for holding (supporting) the lower steel ball assembly 17 in a given space therein so as to provide a bearing function for the center shaft 7. The upper inner wall of cylinder 3 is furnished with female threads for mounting a threaded sleeve 34, a steel ball socket 18, and a pad 33. The sleeve 34 is used for holding the upper steel ball assembly 16 against the upper surface of the ball 12 of the center shaft 7. Upon the two butts being turned, the cylinder and the center shaft 7 have no direct sliding friction surface contact; instead, the ball 12 of the center shaft 7 has rolling friction contact with anti-friction balls 16 and 17.

The top of the lower cylinder 5 is a concave surface; the inner wall of the lower cylinder 5 is furnished with female threads to mate with male threads 11 on the lower rod 8 so as to fix the center shaft 7 in place. The lower end of the lower cylinder 5 is provided with a bottom lid 21 for decorative purposes. The inner wall of the upper cylinder 4 is furnished with female threads having a diameter that is larger than that of the threads in the upper portion of cylinder 3 so as to facilitate insertion of steel ball socket 18, pad 33 and threaded sleeve 34.

Shaft sleeve 19 is screwed into the upper cylinder 4 with its center hole on shaft 7. The bottom face of sleeve 19 is seated on shoulder 14 so as to fix center shaft 7 in place; then, a hexagonal nut 20 is screwed onto threaded area 15. A top lid 6 is finally mounted on the top of the upper cylinder for decorative purposes.

The inner side edges 23 of the left butt 1 have a slanting angle of about 5 degrees; further, the inner wall 24 of the steel ball socket 18, threaded sleeve 34, and flange 22 of cylinder 3 also have a slanting angle of about 5 degrees in relation to the center shaft 7.

Figure 3:
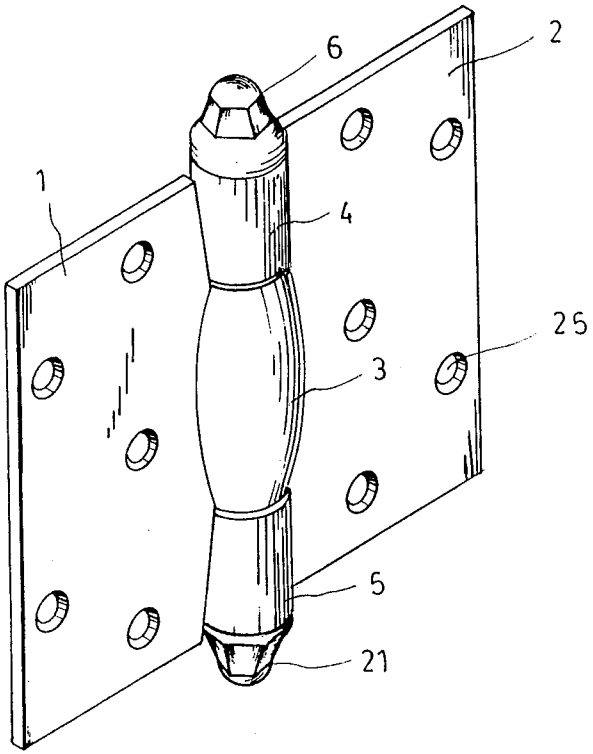
FIG. 3 is a perspective view of the FIG. 1 embodiment
Figure 5:
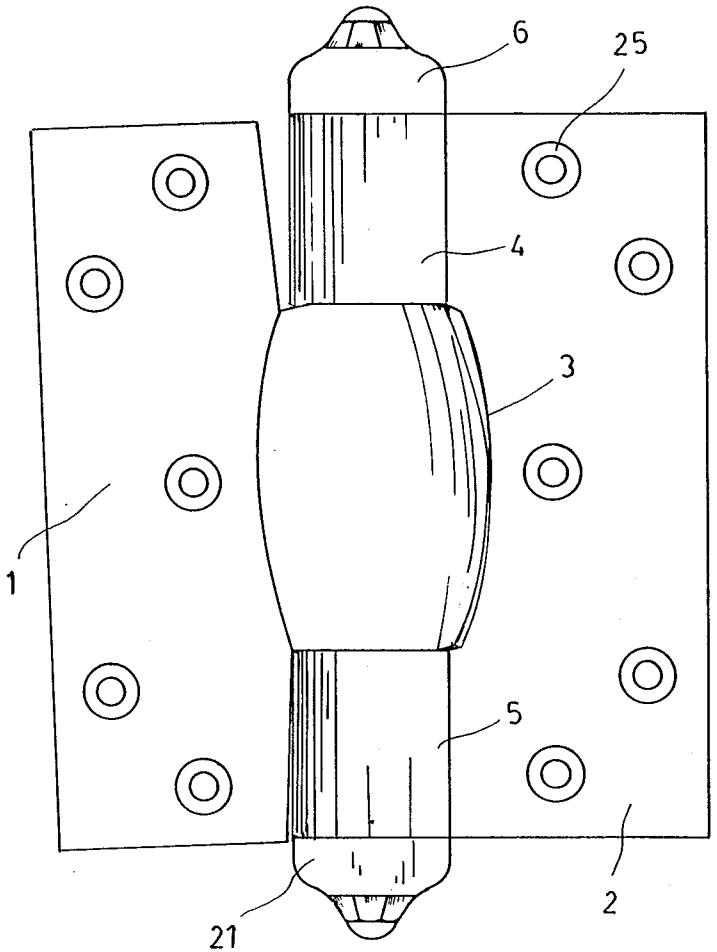
FIG. 5 illustrates the laterally and reversely turning view of embodiment-I of the present invention.
Figure 4:
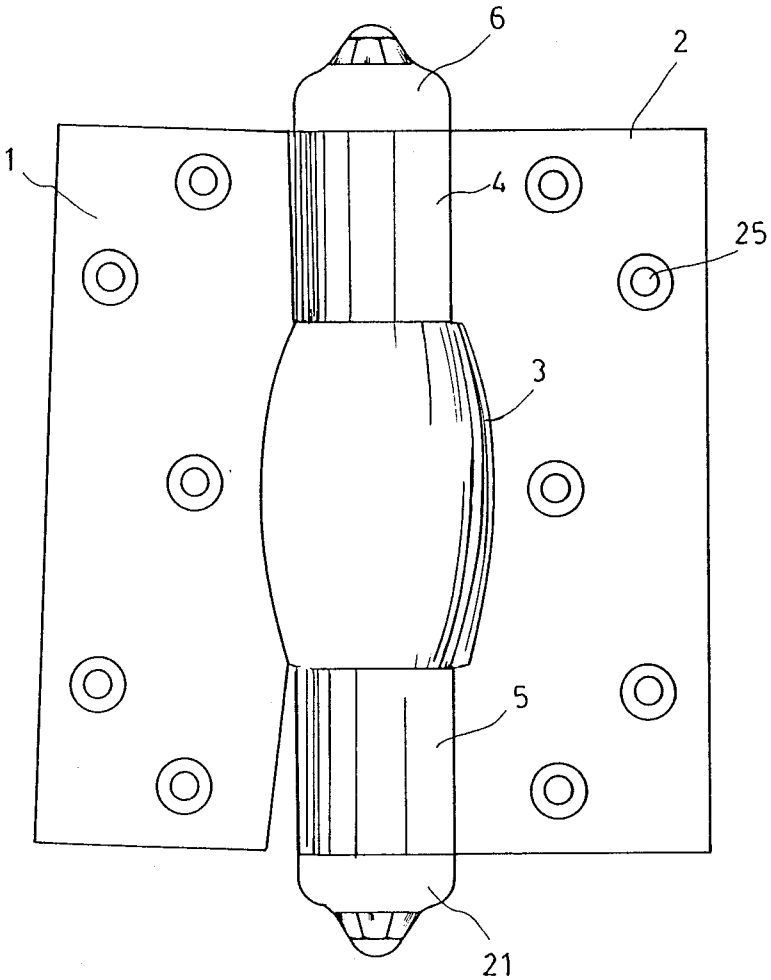
FIG. 4 illustrates the laterally and forward turning view of embodiment-I of the present invention.

FIG. 3 illustrates a perspective view of the FIG. 1 embodiment in which both the top lid 6 and the bottom lid 21 are in place for decorative purposes. Both the left and right butts 1 and 2 are furnished with several screw holes 25 to fix the hinge butts with screws to a movable door (or lid) and an associated stationary part (not shown).

Figure 7:
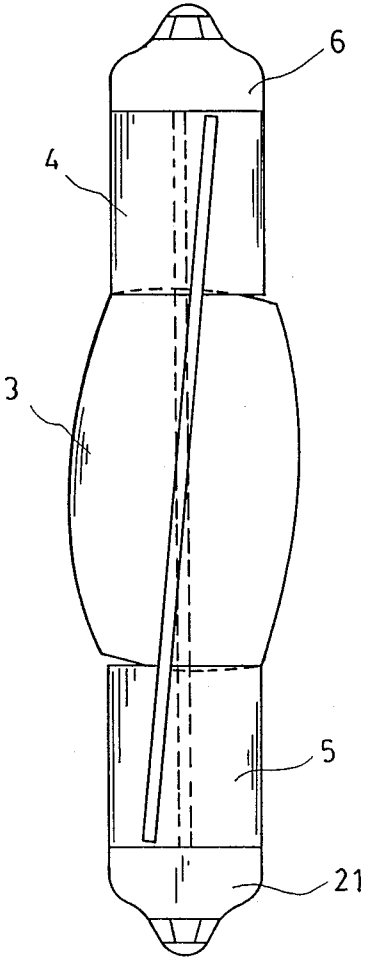
FIG. 7 illustrates the laterally and backwardly declining view of embodiment-I of the present invention.
Figure 6:
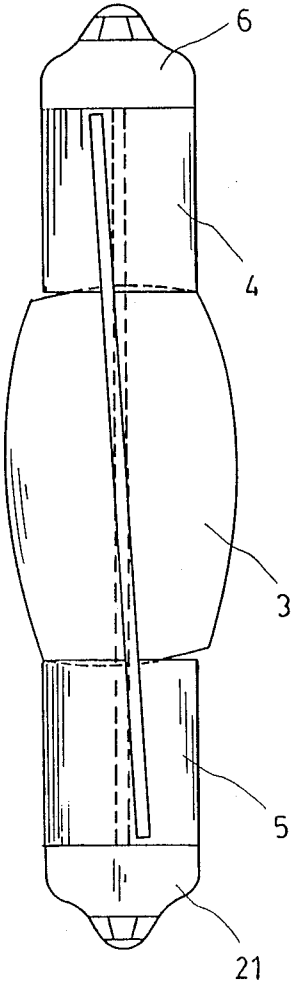
FIG. 6 illustrates the laterally and forward turning view of embodiment-I of the present invention.

FIG. 4, 5, 6, and 7 illustrate the FIG. 1 embodiment set at various positions laterally (obliquely). The hinge according to the present invention has at least 5 degrees play in the plane of the hinge butts (FIGS. 4 and 5) or in the plane normal to the hinge butts (FIGS. 6 and 7). The construction compensates for misalignments between the center lines of plural hinges.

Figure 8:
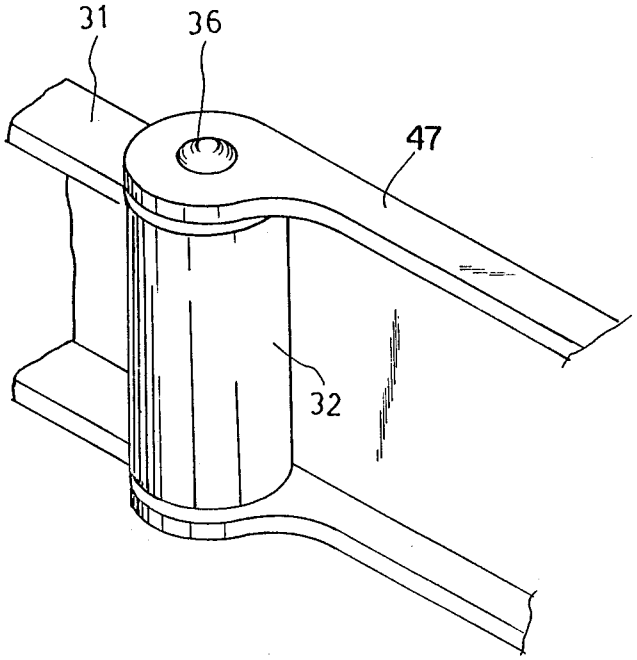
FIG. 8 is a perspective view of a second embodiment of the present invention.

FIG. 8 is a perspective view of a second embodiment of the present invention, used primarily for automobile doors. The left butt 31 is welded to a cylinder 32. Both ends of the right butt 47 are formed into two round flat pieces with two round holes 48 respectively. The right butt 47 is directly mounted on a center shaft 35, which is substantially a hollow cylinder. A pin 36 is mounted inside the center shaft 35; one end of the pin 36 is formed into a semispherical shape; after the other end of the pin 36 is passed through the round holes 48 of the right butt 47, that end will be riveted on the right butt 47. The shape of the two butts may be varied in accordance with different car models.

Figure 9:
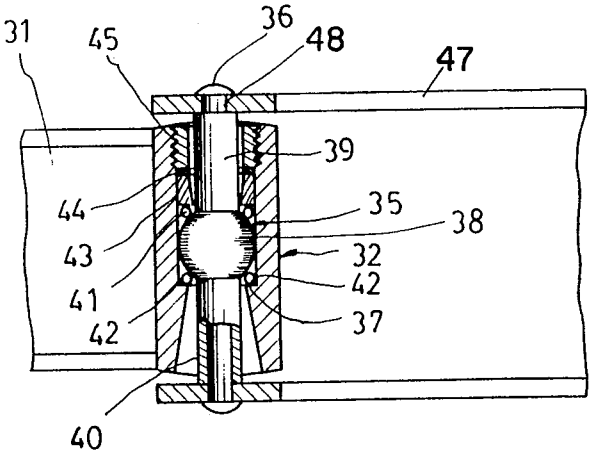
FIG. 9 is a longitudinal section view taken through the second embodiment of the present invention.
Figure 10:
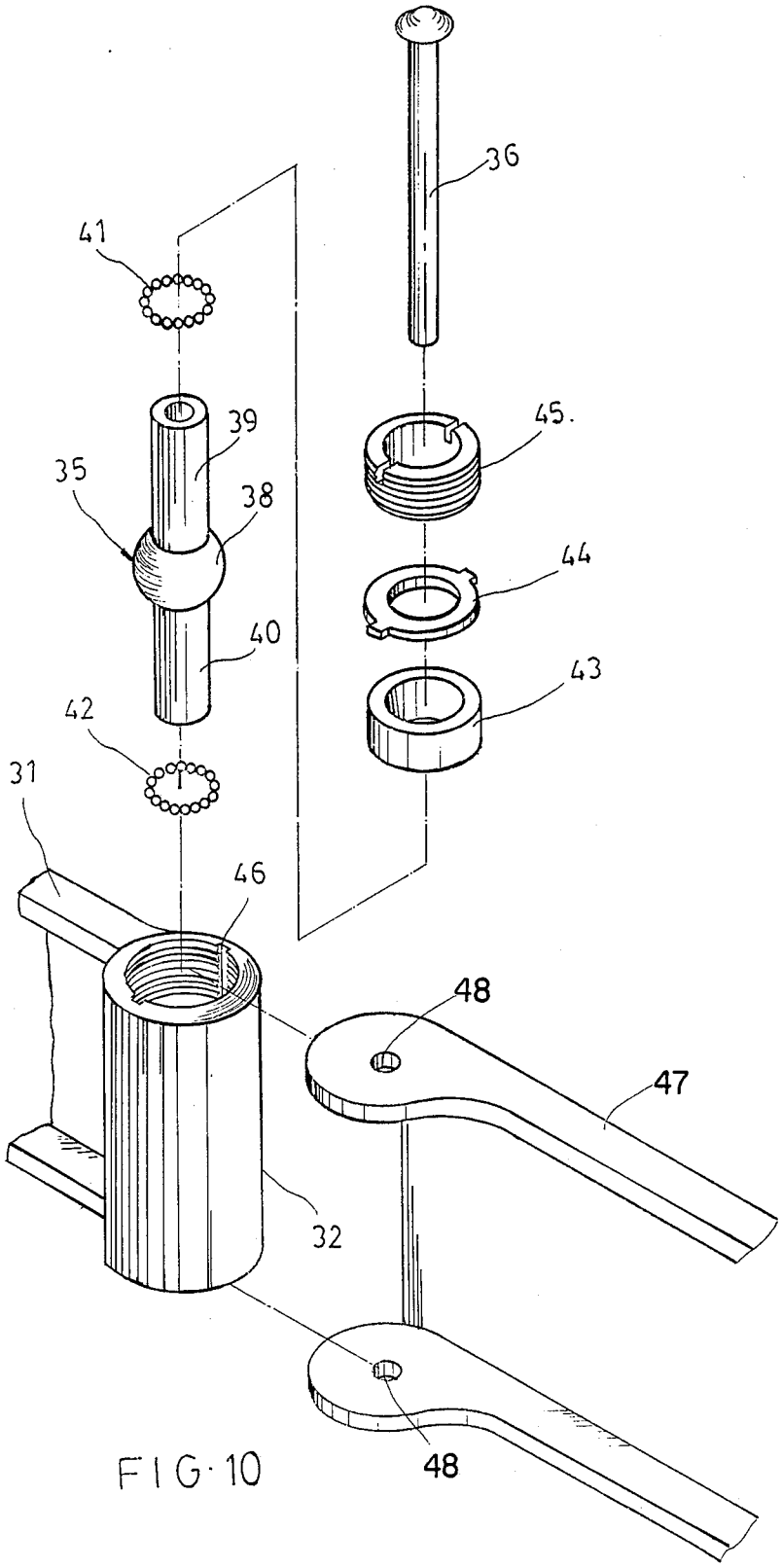
FIG. 10 is a disassembled view of the FIG. 8 embodiment.

FIG. 9 is a longitudinal sectional view of the FIG. 10 embodiment, in which the inner wall of cylinder 32 is furnished with a flange 37, and the center shaft 35 is a round tube with a ball 38 in the midportion thereof; the center shaft 35 includes an upper rod 39 and a lower rod 40. The assembling method of the two sets of ball assemblies 41 and 42, the steel ball socket 43, the pad 44 and the threaded sleeve 45 is the same as that of the FIG. 1 embodiment. Pin 36 is put through the left and right butts 31 and 47, and the center shaft 35; then the lower end of the pin 36 is riveted so as to have the pin closely fitted with the two holes 48 of the right butt 47. The inner wall of cylinder 32, steel ball socket 43, and threaded sleeve 45 are the same as the corresponding elements in the FIG. 1 embodiment. The inner wall of the cylinder has at least 5 degrees of slanting angle so as to furnish a lateral play of at least 5 degrees.

The present invention is to be used on an ordinary household door or an automobile door; i.e., one butt of the hinge is mounted on the moveable part, while the other butt is mounted on the fixed part of the door. Since the hinge according to the present invention has 5 degrees play in any lateral direction, any door may be installed with two (or more than two) hinges according to the present invention without special alignment procedures. Further, since the moving parts of the hinge of the present invention are designed for rolling friction, the frictional resistance and associated noise can be reduced to a minimum.

I claim:

1. A hinge structure comprising a vertically positionable cylinder (3 or 32) having an internal annular flange (22 or 37); a ring of anti-friction balls (17 or 42) seated on the upper face of said annular flange;

a shaft (7 or 35) extending through the space circumscribed by said cylinder, said shaft including a spherical center section (12 or 38) seated on said ring of anti-friction balls, a first rod-like section (8 or 40) extending downwardly from the shaft center section to a point below the cylinder, and a second rod-like section (13 or 39) extending upwardly from the shaft center section to a point above the cylinder;

a second ring of anti-friction balls (16 or 41) seated on the upper surface of the spherical center section;

an annular socket member (18 or 43) positioned in the cylinder directly above the second ring of anti-friction balls, said socket member having a lower face extending normal to the cylinder axis in direct contact with the second ring of antifriction balls;

an annular threaded sleeve (34 or 45) threaded into the upper end section of the cylinder in pressure engagement with the annular socket member to cause said socket member and annular flange to exert a controlled force on the anti-friction balls and spherical center section of the shaft, thereby preventing axial play between the shaft and cylinder;

a first hinge member (1 or 31) affixed to the cylinder;

and a second hinge member (2 or 47) affixed to the shaft;

the rod-like sections of the shaft having substantial radial clearances relative to the annular flange, annular socket member and threaded sleeve whereby the shaft axis can be obliquely angled to the axis of the cylinder.

2. The hinge structure of claim 1 wherein said shaft has an axial hole extending there through, and an elongated pin (36) extending through said axial hole to affix the shaft to the second hinge member.

3. The hinge structure of claim 1 wherein end areas of the rod-like shaft sections are threaded to connect the shaft to the second hinge member.

* * * * *